US005921760A

United States Patent [19]

Isozumi et al.

[11] Patent Number: 5,921,760

[45] Date of Patent: Jul. 13, 1999

[54] HIGH-PRESSURE FUEL-FEED PUMP HAVING A SLIT ON THE UPPER WALL OF THE COMPRESSION CYLINDER

[75] Inventors: Shuzo Isozumi; Hideki Morikaku; Keiichi Konishi; Wakaki Miyaji, all of Tokyo, Japan

[73] Assignee: Mitsubishi Denki Kabushiki Kaisha, Tokyo, Japan

[21] Appl. No.: 08/967,893

[22] Filed: Nov. 12, 1997

[30] Foreign Application Priority Data

May 16, 1997 [JP] Japan ..... 9-127029

[51] Int. Cl.[6] ..... F04B 19/22

[52] U.S. Cl. ..... 417/470; 417/569; 92/169.1

[58] Field of Search ..... 417/470, 569; 92/169.1, 171.1

[56] References Cited

U.S. PATENT DOCUMENTS

| | | | |
|---|---|---|---|
| 2,880,043 | 3/1959 | Landis | 309/3 |
| 3,209,659 | 10/1965 | Colwell | 92/171 |
| 3,333,513 | 8/1967 | Wettstein | 92/165 |
| 5,567,134 | 10/1996 | Inoue . | |

FOREIGN PATENT DOCUMENTS

| | | |
|---|---|---|
| 8-14140 | 1/1996 | Japan . |
| 8-68370 | 3/1996 | Japan . |
| 8-210219 | 8/1996 | Japan . |
| A-66-121341 | 6/1998 | Japan . |

*Primary Examiner*—Charles G. Freay
*Assistant Examiner*—Ehud Gartenberg
*Attorney, Agent, or Firm*—Sughrue, Mion, Zinn, Macpeak & Seas, PLLC

[57] ABSTRACT

A high-pressure fuel-feed pump comprising: a pump body a locking member screwed to the pump body; a cylinder arranged between the locking member and the pump body, the cylinder including a fixing portion for receiving a compression force in a longitudinal direction when the locking member is screwed to the pump body, and a sliding portion continuous with the fixing portion and extending in the longitudinal direction; a plunger reciprocapable in the sliding portion of the cylinder; and a driving member for driving the plunger; wherein the fixing portion of the cylinder has a slit formed therein.

7 Claims, 5 Drawing Sheets

SHAPE BEFORE TIGHTENING

DEFORMED SHAPE AFTER TIGHTENING

——— SHAPE BEFORE TIGHTENING

——— DEFORMED SHAPE AFTER TIGHTENING

——— SHAPE BEFORE TIGHTENING

▬▬▬ DEFORMED SHAPE AFTER TIGHTENING

HIGH-PRESSURE FUEL-FEED PUMP HAVING A SLIT ON THE UPPER WALL OF THE COMPRESSION CYLINDER

BACKGROUND OF THE INVENTION

1. Field of the Invention

The present invention relates to a high-pressure fuel-feed pump which is used in an engine.

2. Discussions of Background

In FIG. 6, there is shown a sectional view of a conventional high-pressure fuel-feed pump. In this Figure, reference numeral 1 designates the high-pressure fuel feed pump which can be mounted to e.g. a housing of an engine (not shown), reference numeral 2 designates an intake port of the pump, reference numeral 3 designates an intake passage which forms the intake port, reference numeral 4 designates an intake valve which is arranged in an intake passage for fuel entering from the intake passage, reference numeral 5 designates a valve seat which has the intake valve contacted therewith and separated therefrom, reference numeral 6 designates a compression coil spring which urges the intake valve 4 against the valve seat 5, reference numeral 7 designates a spring guide which guides the compression coil spring, reference numeral 8 designates a threaded portion, reference numeral 9 designates a copper washer.

Reference numeral 10 designates a delivery valve as a locking member, reference numeral 11 designates a discharge valve which forms the delivery valve, reference numeral 12 designates a valve seat which has the discharge valve contacted therewith and separated therefrom, reference numeral 13 designates a compression coil spring which urges the discharge valve which against the valve seat 12, reference numeral 14 designates a discharge port, reference numeral 15 designates a threaded portion which is formed on outer periphery of a lower portion of the delivery valve 10, reference numeral 16 designates a seal housing portion which is formed on the outer periphery of the delivery valve at a position higher than the threaded portion, reference numeral 17 designates a pump body which has the delivery valve 10, the intake valve 4 and other members mounted thereto, reference numeral 18 designates a threaded portion which is formed in the pump body to have the intake port 2, the intake valve 4 and other members screwed therein, and reference numeral 19 designates a threaded potion which is formed on the pump body 17 to have the delivery valve 10 mounted thereto.

Reference numeral 20 designates a cylinder which is arranged between the delivery valve 10 and the pump body 17. Reference numeral 21 designates an annular fixing portion which is formed on an upper portion of the cylinder, and which receives a compression force in a longitudinal direction (a vertical direction) when the delivery valve 10 is screwed into the pump body 17.

Reference numeral 22 designates a cylindrical sliding portion of the cylinder which is integrally continuous to the fixing portion and extends in the longitudinal direction, reference numeral 23 designates a plunger which is reciprocated in the sliding portion of the cylinder, and reference numeral 24 designates a tappet which receives a head portion 23*a* on a lower end of the plunger, which is formed in a bottomed shape, and which is supported in a tappet sliding portion 17*a* of the pump body 17 so as to be slidable. Reference numeral 25 designates a spring seat which is mounted to the lower end of the plunger 23. Reference numeral 26 designates a compression coil spring which is arranged between the spring seat and the pump body 17, and which urges the spring seat 25 and the plunger 23 downwardly.

Reference numeral 27 designates a cam which contacts with the tappet 24, and which is driven by the engine at a half of the rotation of the engine. Reference numeral 28 designates a fuel pressurization chamber which is defined by the cylinder 20 and the plunger 23, reference numeral 29 designates a copper washer which is arranged between the pump body 17 and the cylinder 20. Reference numeral 30 designates an O ring which is arranged in the seal housing portion 16 of the delivery valve 10. Reference numeral 31 designates a copper washer which is arranged between the delivery valve 10 and the cylinder 20.

When the unshown engine starts and rotates the cam 27, the plunger 23 is reciprocated through the tappet 24.

When the plunger slides downwardly, the intake valve 4 lifts against the action of the compression coil spring 6, allowing fuel to be inspired into the fuel pressurization chamber 28 through the intake passage 3.

When the plunger 23 slides upwardly, the discharge valve 11 is urged by the compression coil spring 13 to contact with the valve seat 12 until the pressure in the fuel pressurization chamber 28 reaches a predetermined value. When the pressure in the fuel pressurization chamber 28 reaches the predetermined value by a further raise of the plunger 23, the discharge valve 11 lifts upwardly to open against the action of the compression coil spring 13, the fuel is supplied to a fuel pipe at a high pressure side (not shown) through the discharge port 14.

When such a conventional device is assembled, the cylinder 20 is inserted into a hollow accommodation portion of the pump body 17 through the copper washer 29, the delivery valve 10 with the discharge valve 11 and the compression coil spring 13 housed therein is screwed into the pump body 17 through the copper washer 31 on the cylinder 20 by engaging the threaded portions 19 and 15, and the delivery valve 10 is downwardly screwed to be tightened. At that time, the fixing portion 21 of the cylinder 20 receives the compression force in the longitudinal direction by the screwing of the delivery valve 10 to be firmly sandwiched between the delivery valve 10 and the pump body 17.

On the other hand, the intake port 2 with the intake valve 4, the valve seat 5, the compression coil spring 6 and the spring guide 7 housed therein is screwed in a hollow accommodation portion in a right side of the pump 17 through the treaded portion 8.

Next, the plunger 23 is inserted into the sliding portion 22 of the cylinder 20 from below the pump body 17 through the compression coil spring 26 and the spring seat 25, and the tappet 24 is mounted in the tappet sliding portion 17*a* of the pump body 17 so as to be slidable therein so that the tappet supports the plunger head portion 23*a*.

In the conventional high-pressure fuel-feed pump, when the delivery valve 10 as the locking member is screwed into the pump body 17, the fixing portion 21 of the cylinder 20 is subjected to the compression force in the longitudinal direction by the screwing of the delivery valve 10. The conventional fuel-feed pump has involved a problem in that, as shown in FIG. 7, the compression force deforms an inner peripheral surface of the sliding portion 22 to provide inward projection so as to contact the inner peripheral surface with the plunger 23, causing the plunger 23 to be abnormally worn and be subjected to seizing.

A raise in the discharge pressure of the high-pressure fuel-feed pump deteriorates sealing property between the delivery valve 10 and the cylinder 20, and between the pump body 17 and the cylinder 20, providing need for an increase in a tightening force of the locking member such as the delivery valve 20. This has created a problem in that the deformation of the inner periphery surface of the sliding portion 22 is further developed to subject the plunger 23 to easy seizing.

SUMMARY OF THE INVENTION

It is an object of the present invention to solve these problems and to provide a high-pressure fuel-feed pump capable of restraining deformation of a sliding surface of cylindrical sliding portion with a plunger to prevent the plunger from being seized.

According to a first aspect of the present invention, there is provided a high-pressure fuel-feed pump which comprises a pump body; a locking member screwed to the pump body; a cylinder arranged between the locking member and the pump body, the cylinder including a fixing portion for receiving a compression force in a longitudinal direction when the locking member is screwed to the pump body, and a sliding portion continuous with the fixing portion and extending in the longitudinal direction; a plunger reciprocapable in the sliding portion of the cylinder; and a driving member for driving the plunger; wherein the fixing portion of the cylinder has a slit formed therein.

According to a second aspect of the present invention, the slit is formed in a ring shape.

According to a third aspect of the present invention, the slit is formed in a longitudinal direction of the plunger.

According to a fourth aspect of the present invention, the slit opens to an end of the fixing portion near to the driving member.

According to a fifth aspect of the present invention, the slit has a bottom in a longitudinal direction thereof positioned at a level which is not lower than a maximum level of a reciprocation of a head of the plunger.

According to a sixth aspect of the present invention, the locking member is a delivery valve having a discharge valve.

According to a seventh aspect of the present invention, the locking member is a casing having a intake passage and a discharge passage.

In accordance with the first aspect, deformation of the plunger sliding portion in the cylinder can be restrained to prevent the plunger from being seized and to allow an increase in a tightening force by the locking member. As a result, sealing properties between the locking member and the pump body, and between the pump body and the cylinder can be sufficiently ensured to provide a high-pressure fuel-feed pump with fuel leakage minimized.

In accordance with the second aspect, the fabrication of the slit is simple, and deformation of the plunger sliding portion in the cylinder can be restrained in a sufficient manner.

In accordance with the third aspect, the deformation of the plunger sliding portion in the cylinder can be restrained in a further effective manner.

In accordance with the fourth aspect, the deformation of the plunger sliding portion in the cylinder can be more surely restrained, further improving a seizing prevention effect for the plunger.

In accordance with the fifth aspect, the deformation of the plunger sliding portion in the cylinder, in particular, due to inward projection of the cylinder can be surely restrained.

In accordance with the sixth aspect, there is offered advantages in that the number of required parts can be reduced and that the device can be made smaller.

In accordance with the seventh aspect, a sealing property can be improved to provide the device wherein fuel leakage is further minimized.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiment 1

Figure 1:
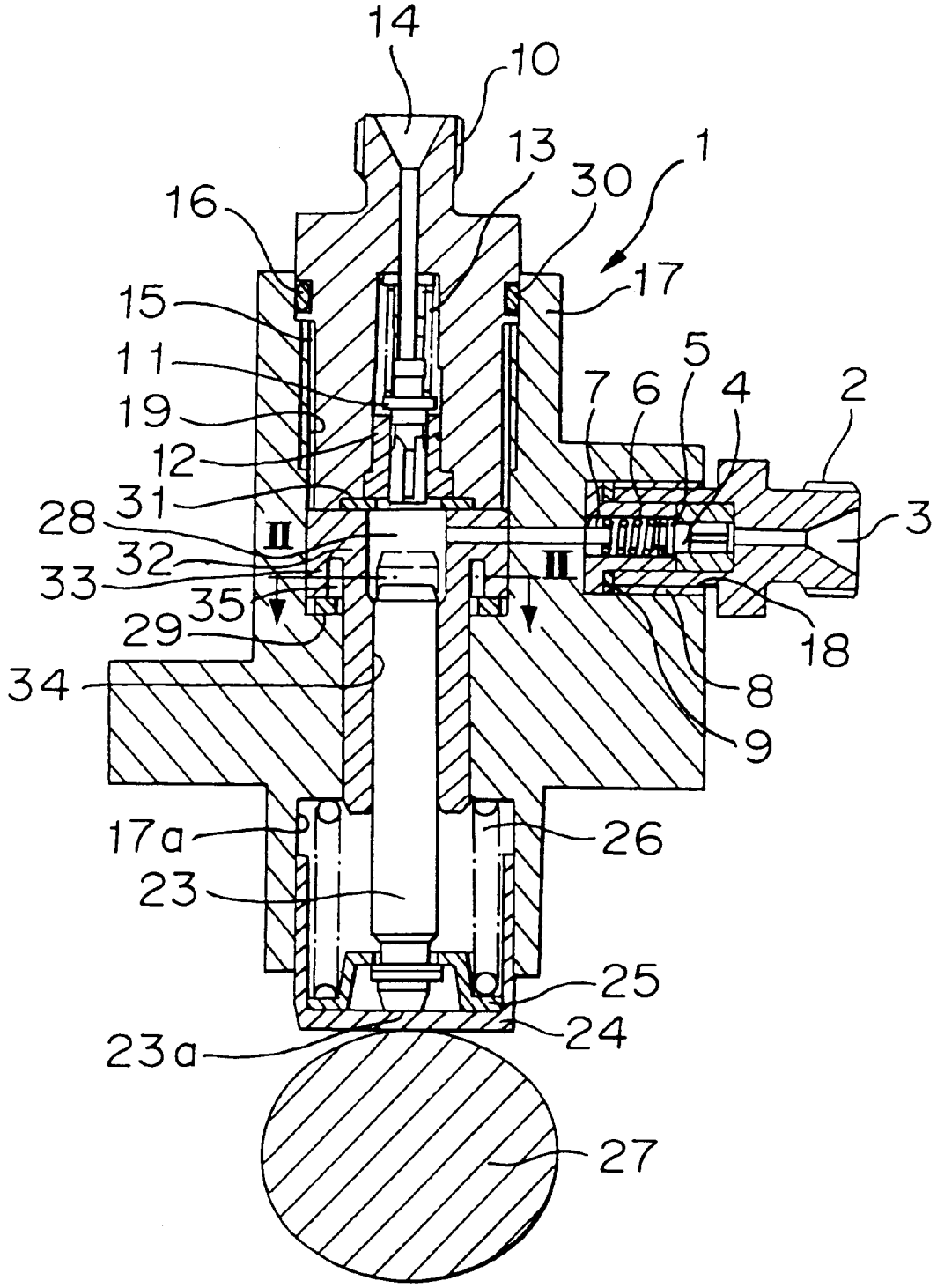
FIG. 1 is a sectional view of the high-pressure fuel-feed pump according to a first embodiment of the present invention.
Figure 2:
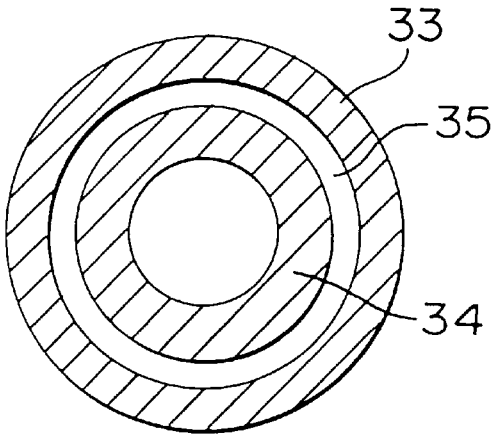
FIG. 2 is a sectional view taken along the line II—II of FIG. 1.

In FIG. 1, there is shown a sectional view of the high-pressure fuel-feed pump according to an embodiment of the present invention. In FIG. 2, there is shown an enlarged sectional view of an essential portion of the high-pressure fuel-feed pump according to the embodiment. In FIG. 1, reference numeral 32 designates a cylinder which is arranged between a delivery valve 10 and a pump body 17. Reference numeral 33 designates an annular fixing portion which is formed on an upper portion of the cylinder, and which receives a compression force in a longitudinal direction (a vertical direction) when the delivery valve 10 is screwed into the pump body 17. Reference numeral 34 designates a cylindrical sliding portion which is integrally continuous to the fixing portion and extends in the longitudinal direction.

Reference numeral 35 designates an annular slit which is formed in a lower end of the fixing portion 33, and which is shown in an enlarged form in FIG. 2 as a sectional view taken along the line II—II of FIG. 1.

Figure 3:
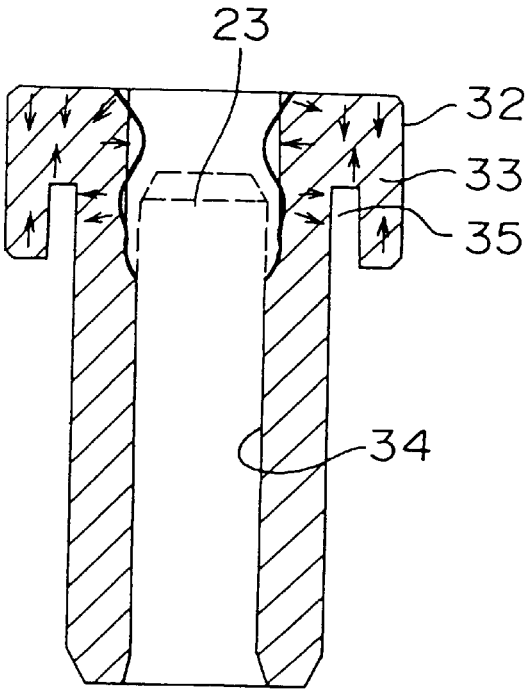
FIG. 3 is an enlarged sectional view of an essential part of the first embodiment.

When the pump constructed according to the embodiment is assembled, the cylinder 32 is inserted into a hollow accommodation portion of the pump body 17 through a copper washer 29, the delivery valve 10 with a discharge valve 11 and a compression coil spring 13 housed therein is screwed into the pump body 17 through a copper washer 31 on the cylinder by engaging a threaded portion 19 of the pump body and a threaded portion 15 of the delivery valve, and the delivery valve 10 is downwardly screwed into the pump body to be tightened with the pump body. At that time, the fixing portion 33 of the cylinder 32 is subjected to the compression force in the longitudinal direction by the screwing of the delivery valve 10. Since the fixing portion 33 of the cylinder 32 has the slit 35 formed therein, the fixing portion 33 is distorted by application of the tightening force of the delivery valve 10 to the fixing portion 33 as shown in FIG. 3.

There is no inward projection on a sliding surface of the cylindrical slicing portion 34 with a plunger 23. Instead, distortion is caused as inward projection of the cylinder 32 at a position higher than the maximum raising position of the plunger 23 in the cylinder 32.

Because the plunger 23 can smoothly reciprocate in the cylindrical sliding portion 34 in the vertical direction in a reciprocation in the cylinder 32, there is no possibility that the plunger 23 is seized.

The provision of the slit 35 allows an increase in the tightening force of the delivery valve 10 to ensure sealing properties between the delivery valve 10 and the cylinder 32, and between the pump body 17 and the cylinder 32, providing a high-pressure fuel-feed pump with fuel leakage minimized. Even if there are variations in an axial force due to variations in the tightening force of the delivery valve 10, the provision of the slit 35 can restrain the cylinder 32 from being distorted in a stable manner.

Embodiment 2

Figure 4:
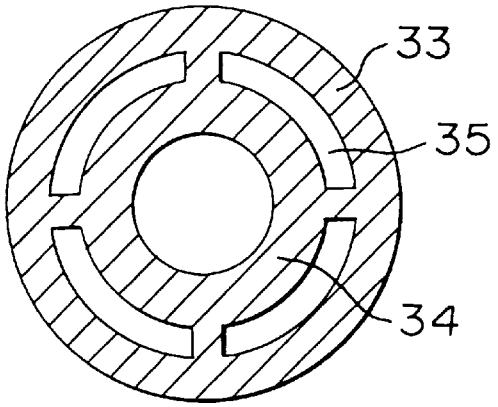
FIG. 4 is a sectional view of an essential part of the pump according to a second embodiment of the present invention.

Although in the first embodiment, the slit 35 is formed in an annular shape as shown in FIG. 2, the slit 35 may have some portions formed with connection portions as shown in FIG. 4, offering advantages similar to the first embodiment.

Embodiment 3

Figure 5:
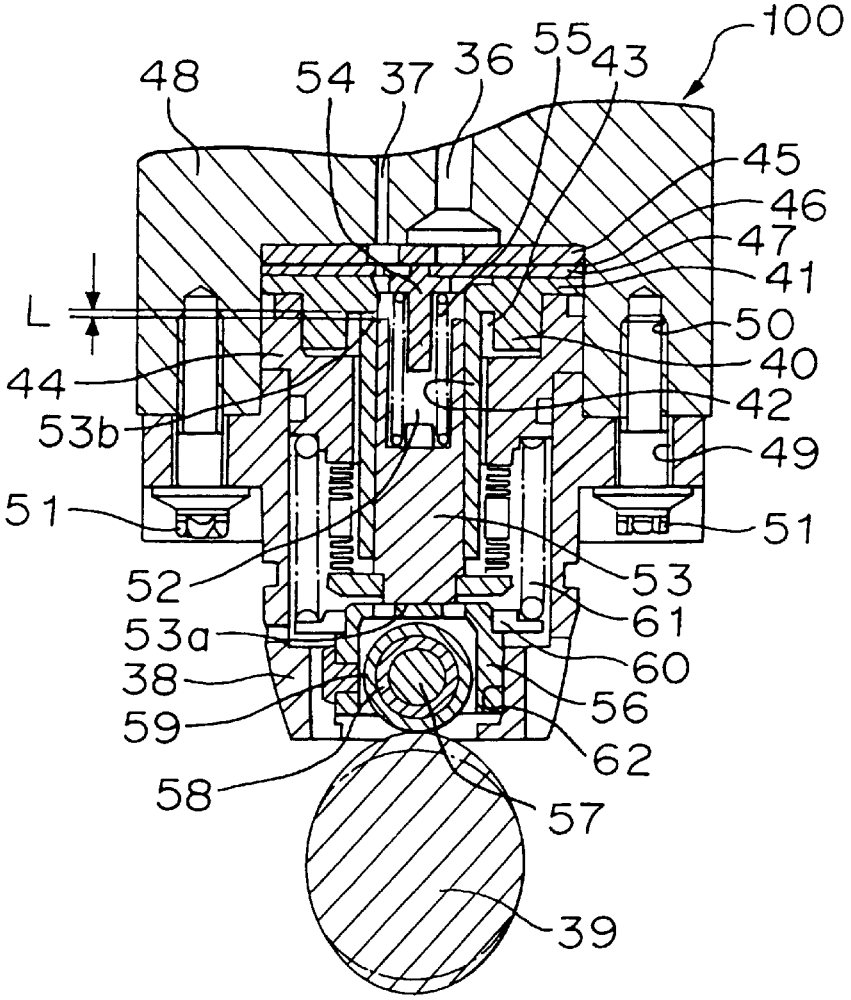
FIG. 5 is a sectional view of the pump according to a third embodiment of the present invention.
Figure 6:
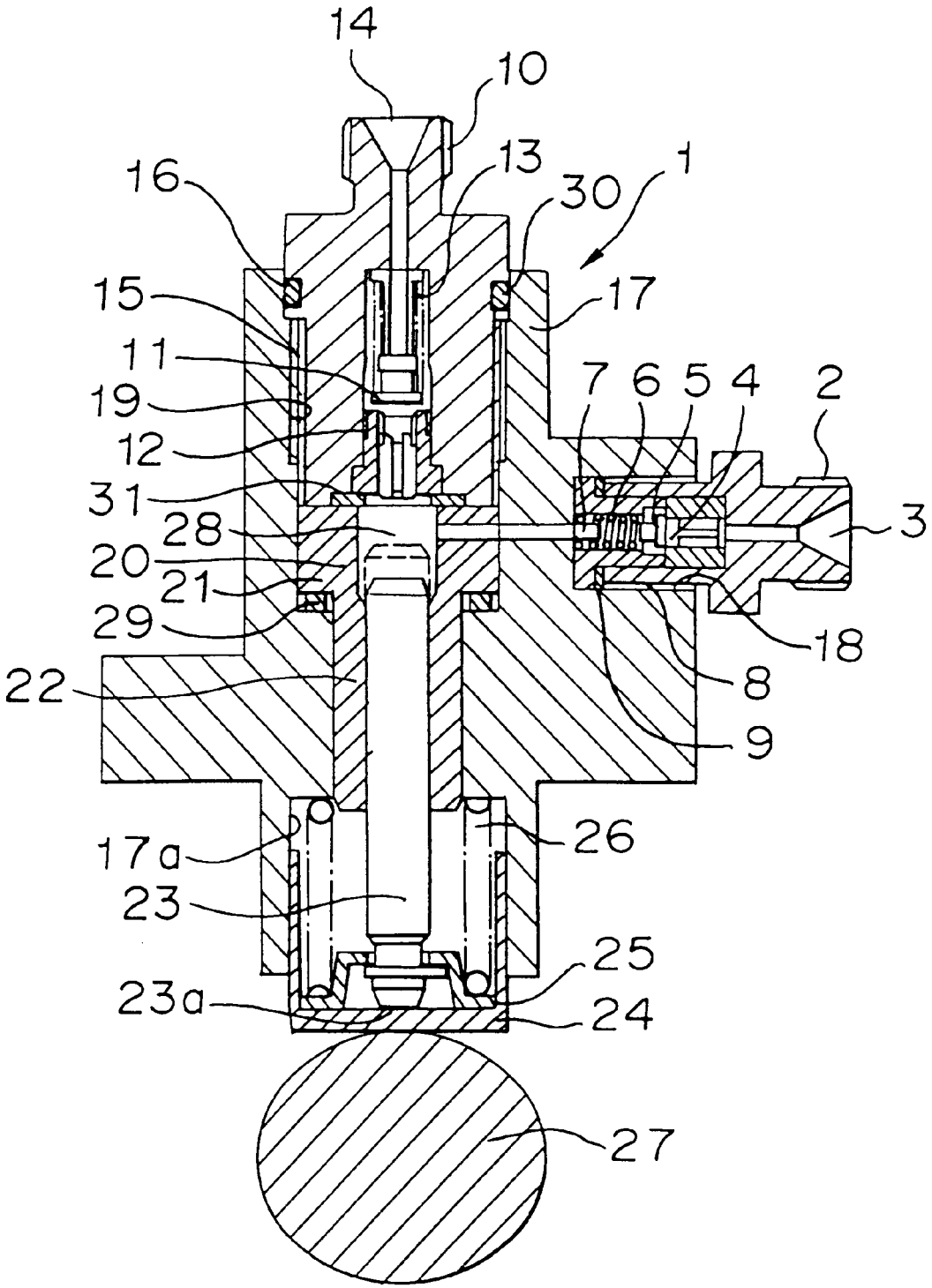
FIG. 6 is a sectional view of a conventional high-pressure fuel-feed pump.
Figure 7:
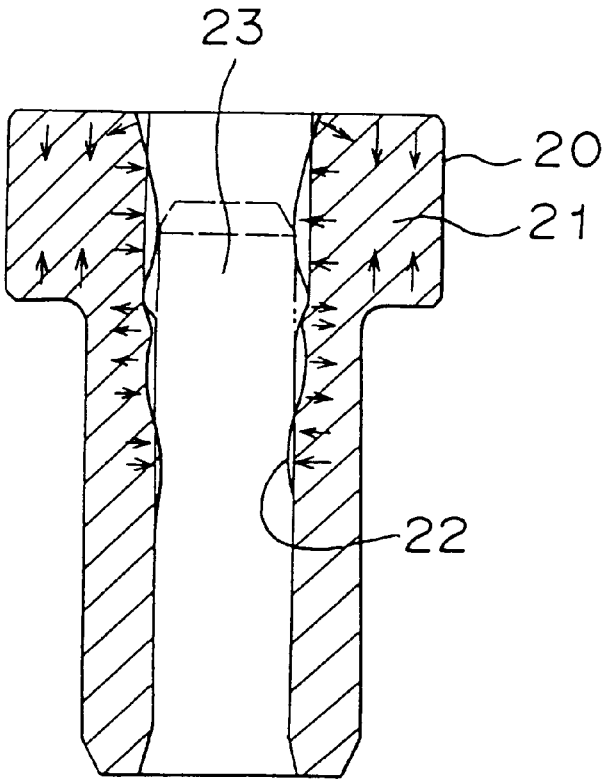
FIG. 7 is an enlarged sectional view of an essential portion of the conventional pump.

In FIG. 5, there is shown a sectional view of a third embodiment of the present invention. In FIG. 5, reference numeral 100 designates the high-pressure fuel-feed pump according to the third embodiment which includes an intake passage 36 and a discharge passage 37 in communication with a fuel pipe (not shown). Reference numeral 38 designates a pump body which is fixed to a housing of an engine (not shown). Reference numeral 39 designates a pump cam which is carried on a valve cam shaft (not shown) and drives the high-pressure fuel-feed pump 100. Reference numeral 40 designates a cylinder which includes an annular fixing portion 41 extending in a vertical direction, a cylindrical sliding portion 42 integrally continuous to the fixing portion and extending in a longitudinal direction (vertical direction), and an annular slit 43 which is formed in the fixing portion 41 at a location near to an upper end of the cylindrical sliding portion 42.

The cylinder 40 is fixedly screwed to a casing 48 as the locking member in the pump body 38 through a housing 44 therebelow and through a plate "A" 45, a valve plate (intake valve/discharge valve) 46 and a plate "B" 47 thereabove.

Reference numeral 49 designates a through hole for fixing which is formed in the pump body 38. Reference numeral 50 designates a threaded hole which is formed in the casing 48. Reference numeral 51 designates a plurality of bolts which extend through the through holes in the pump body 38 and are screwed into the threaded holes 50 in the casing 48. The casing 48 has the intake passage 36 and the discharge passage 37 formed therein, and both passages communicate with a fuel pressurization chamber 52 through the valve plate 46 supported between the plate "A" 45 and the plate "B" 47. Reference numeral 53 designates a plunger which is supported in the cylindrical sliding portion 42 of the cylinder 40 so as to be reciprocapable on an inner wall of the cylindrical sliding portion, and which is downwardly urged by a compression coil spring 55 extended between the plunger and a spring guide 54 mounted to the plate "B" 47.

Reference numeral 56 designates a tappet which is formed in a lidded cylindrical shape and which rotatably supports a pin 57. The pin 57 rotatably carries a first hollow cylindrical roller 58 and a second hollow cylindrical roller 59 thereon, and the second roller 59 contacts with the cam 39. Reference numeral 60 designates a spring seat which contacts with a head of the tappet 56 in such manner the spring seat is urged by a compression coil spring 61.

The plunger 53 has a head portion 53*a* contacted with a top surface of the head of the tappet 56.

Reference numeral 62 designates a tappet sliding portion which is formed in the pump body 38.

In accordance with the third embodiment thus constructed, the plunger 53 is reciprocated in the vertical direction by rotation of the cam 39 through the second roller 59, the first roller 58, the pin 57 and the tappet 56. When the plunger 53 is downwardly slid under the action of the compression coil spring 61, the intake valve (not shown) in the valve plate 46 opens, allowing fuel to be inspired into the fuel pressurization chamber 52 through the intake passage 36. On the other hand, when the plunger 53 is upwardly slid, the discharge valve (not shown) in the valve plate 46 opens, allowing the fuel to be discharged from the fuel pressurization chamber 52 into the discharge passage 37.

In accordance with the third embodiment, when the pump body 38 is fixed into the casing 48 by screwing the bolts 51, the fixing portion 41 of the cylinder 40 is subjected to a compression force in the vertical direction through the housing 44 to deform the cylindrical sliding portion 42. However, there is caused no inward projection deformation on the inner surface of the cylindrical sliding portion 42 with the plunger 53 sliding thereon because the slit 43 is deeply formed so as to be extended to a position higher than a maximum raising position 53*b* of the plunger 53 by a length L in FIG. 5.

Such arrangement can prevent the plunger 53 from being seized. The provision of the slit 43 allows an increase in the tightening force of the casing 48 so as to ensure sealing properties between the casing 48 and the pump body 38, and among the pump body 38, the housing 44 and the cylinder 48, providing a high-pressure fuel-feed pump 100 with fuel leakage minimized.

Even if there are variations in axial force due to variations in the tightening force of the casing 48, the provision of the slit 43 can restrain the cylinder 40 from being distorted in a stable manner.

Obviously, numerous modifications and variations of the present invention are possible in light of the above teachings. It is therefore to be understood that within the scope of the appended claims, the invention may be practiced otherwise than as specifically described herein.

What is claimed is:

1. A high-pressure fuel-feed pump comprising:

a pump body a locking member screwed to the pump body;

a cylinder arranged between the locking member and the pump body, the cylinder including a fixing portion for receiving a compression force in a longitudinal direction when the locking member is screwed to the pump body, and a sliding portion continuous with the fixing portion and extending in the longitudinal direction;

a plunger reciprocapable in the sliding portion of the cylinder; and a driving member for driving the plunger;

wherein the fixing portion of the cylinder has a slit formed therein.

2. A high-pressure fuel-feed pump according to claim 1, wherein the slit is formed in a ring shape.

3. A high-pressure fuel-feed pump according to claim 1, wherein the slit is formed in a longitudinal direction of the plunger.

4. A high-pressure fuel-feed pump according to claim 1, wherein the slit opens to an end of the fixing portion near to the driving member.

5. A high-pressure fuel-feed pump according to claim 4, wherein the slit has a bottom in a longitudinal direction thereof positioned at a level which is not lower than a maximum level of a reciprocation of a head of the plunger.

6. A high-pressure fuel-feed pump according to claim 1, wherein the locking member is a delivery valve having a discharge valve.

7. A high-pressure fuel-feed pump according to claim 1, wherein the locking member is a casing having a intake passage and a discharge passage.

* * * * *